US007044335B2

(12) United States Patent
Aguirre et al.

(10) Patent No.: US 7,044,335 B2
(45) Date of Patent: May 16, 2006

(54) SELF-CONTAINED BEVERAGE DISPENSING APPARATUS

(75) Inventors: Carlos J. Aguirre, Woodland Hills, CA (US); Robert M. Norton, Parker, CO (US); Chris Pearson, III, Parker, CO (US); Bobby Joe Stephens, Birmingham, AL (US)

(73) Assignee: SIP Systems LLC, Parker, CO (US)

( * ) Notice: Subject to any disclaimer, the term of this patent is extended or adjusted under 35 U.S.C. 154(b) by 0 days.

(21) Appl. No.: 10/846,986

(22) Filed: May 14, 2004

(65) Prior Publication Data

US 2004/0226960 A1 Nov. 18, 2004

Related U.S. Application Data

(60) Provisional application No. 60/471,120, filed on May 16, 2003.

(51) Int. Cl.
*B67D 5/56* (2006.01)

(52) U.S. Cl. ..... 222/129.1; 222/146.6; 222/608; 62/389

(58) Field of Classification Search ..... 222/129.1, 222/52, 129.2, 63, 129.3, 61, 129.4, 130–135, 222/608, 610, 94, 153.14, 399, 400.7, 626, 222/146.6; 62/389–390, 398, 371, 457.3
See application file for complete search history.

(56) References Cited

U.S. PATENT DOCUMENTS 1,979,549 A * 11/1934 Huckel ..... 62/462
3,112,844 A * 12/1963 Keller et al. ..... 222/61
3,180,529 A * 4/1965 Buffington ..... 222/131
3,232,489 A * 2/1966 Buffington ..... 222/108
3,240,395 A * 3/1966 Carver ..... 222/129.1
3,327,902 A * 6/1967 Alterwitz ..... 222/108
3,677,173 A * 7/1972 Fogle et al. ..... 99/357
3,735,898 A * 5/1973 Smith ..... 222/129.4
3,777,937 A * 12/1973 Buck ..... 222/641
4,225,059 A * 9/1980 Kappos ..... 222/146.6
5,411,179 A 5/1995 Oyler et al. ..... 222/129.1
5,526,957 A * 6/1996 Brown et al. ..... 222/94
5,553,749 A 9/1996 Oyler et al. ..... 222/129.1
6,021,922 A 2/2000 Bilskie et al. ..... 222/67
6,216,913 B1 4/2001 Bilskie et al. ..... 222/67

(Continued)

OTHER PUBLICATIONS

"Fount In Server" Brochure, Sterling Beverage Systems, Inc., printed on Jul. 14, 2004 from www.sterlingbeverage.com, 20 pgs.

(Continued)

*Primary Examiner*—Frederick Nicolas
(74) *Attorney, Agent, or Firm*—Sheridan Ross P.C.

(57) ABSTRACT

A self-contained beverage dispensing apparatus, which is adapted for commercial and/or home use as an alternative to traditional canned beverage service, is provided. In one embodiment, the beverage dispensing apparatus is highly portable and of sufficient dimension to be positioned on a conventional airline beverage cart and stored in an aircraft's cargo storage compartment. In one embodiment, the beverage dispensing apparatus can be selectively locked and secured with a mechanism that will indicate whether any pre-flight tampering has occurred. In one embodiment, the beverage dispensing apparatus is further comprised of at least one beverage dispensing mechanism that can be extended from within the housing for use and later retracted for storage. In one embodiment, the beverage dispensing apparatus can be used with beverage containers with mouths of varying sizes.

35 Claims, 8 Drawing Sheets

U.S. PATENT DOCUMENTS

| | | | | |
|---|---|---|---|---|
| 6,234,349 | B1 | 5/2001 | Bilskie et al. | 222/67 |
| 6,253,960 | B1 | 7/2001 | Bilskie et al. | 222/67 |
| 6,296,153 | B1 | 10/2001 | Bilskie et al. | 222/249 |

OTHER PUBLICATIONS

"Award-Winning Convenience" Article, Delta Inflight Insights, Jun. 2000, printed from Feb. 20, 2001 portion of www.archive.org website for www.sterlingbeverage.com, 2 pgs.

"Delta's Laboratory Tests For Success" Article by K. Tucker, Newswatch, Jan. 24, 2000, printed from Feb. 20, 2001 portion of www.archive.org website for www.sterlingbeverage.com, 3 pgs.

"Testing Is Complete For Breakthrough Beverage System" Article by G. Hulcher, Onboard Services Magazine, Sep. 1999, printed from Feb. 20, 2001 portion of www.archive.org website for www.sterlingbeverage.com, 3 pgs.

"A Revolution In The Air" Article, Onboard Services Magazine, Apr. 1999, printed from Feb. 20, 2001 portion of www.archive.org website for www.sterlingbeverage.com, 6 pgs.

"Miniature Fittings Enhance Airline Beverage Service" Article, Machine Design, Jul. 22, 1999, printed from Feb. 20, 2001 portion of www.arhive.org website for www.sterlingbeverage.com, 3 pgs.

"Beverage Cart With Ambition To Fly" Article by A. O'Neill, Atlanta Business Chronicle, May 21-27, 1999, printed from Feb. 20, 2001 portion of www.archive.org website for www.sterlingbeverage.com, 5 pgs.

"Dispenser System Awaits FAAA Approval" Article, PAX International, Feb./Mar. 1998, printed from Feb. 20, 2001 portion of www.archive.org website for www.sterlingbeverage.com, 3 pgs.

"Prototype Trolley" Article, Hospitality Industry International, 1996/Issue 11, printed from Feb. 20, 2001 portion of www.archive.org website for ww.sterlingbeverage.com, 2 pgs.

"Looking To The East" Article by D. Henderson, Air Transport World, Apr. 1996, printed from Feb. 20, 2001 portion of www.archive.org website for www.sterlingbeverage.com, 4 pgs.

"Sterling Is In The News," Sterling Beverage Systems, Inc., printed from Feb. 20, 2001 portion of www.archive.org website for www.sterlingbeverage.com, 2 pgs.

"A Revolution In The Air," Sterling Beverage Systems, Inc., printed from Feb. 20, 2001 portion of www.archive.org website for www.sterlingbeverage.com, 3 pgs.

"Frequently Asked Question," Sterling Beverage Systems, Inc., printed from Feb. 20, 2001 portion of www.archive.org website for www.sterlingbeverage.com, 3 pgs.

"Sterling Beverage Systems," Sterling Beverage Systems, Inc., printed from Feb. 20, 2001 portion of www.archive.org website for www.sterlingbeverage.com, 3 pgs.

* cited by examiner

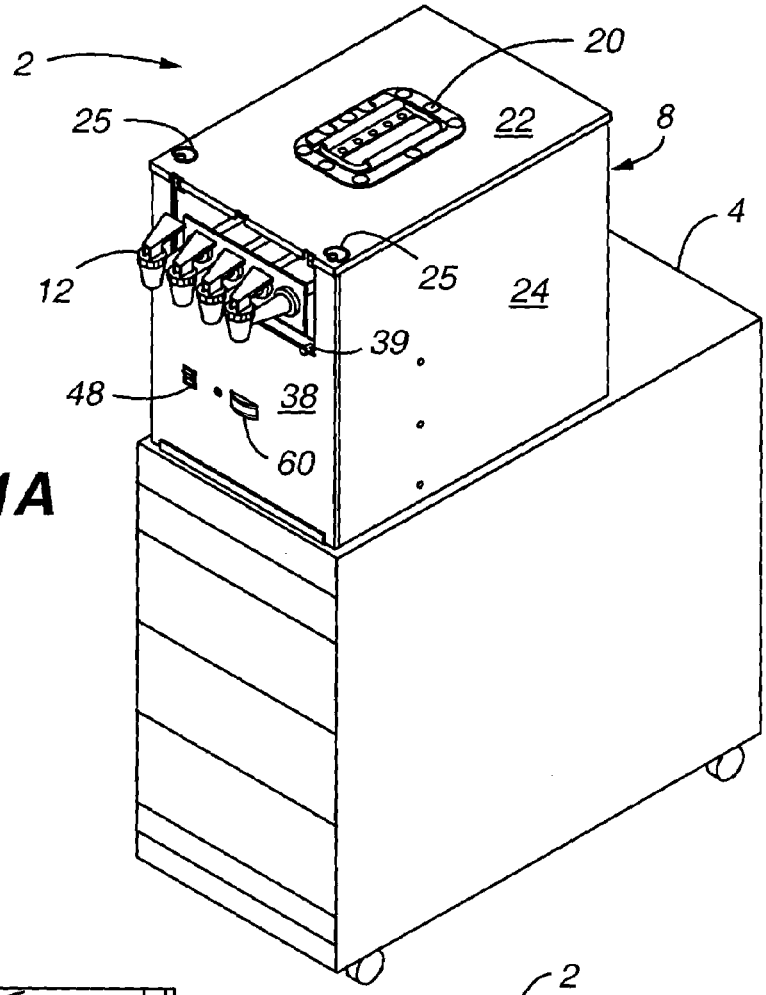
Fig. 1A
Fig. 1B
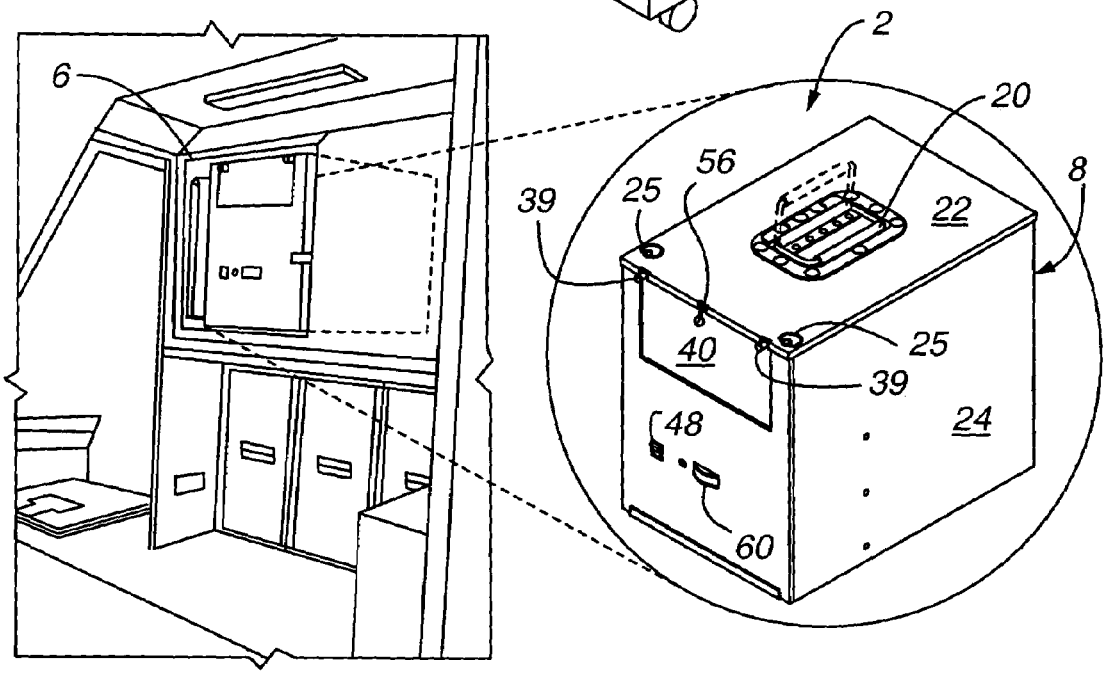

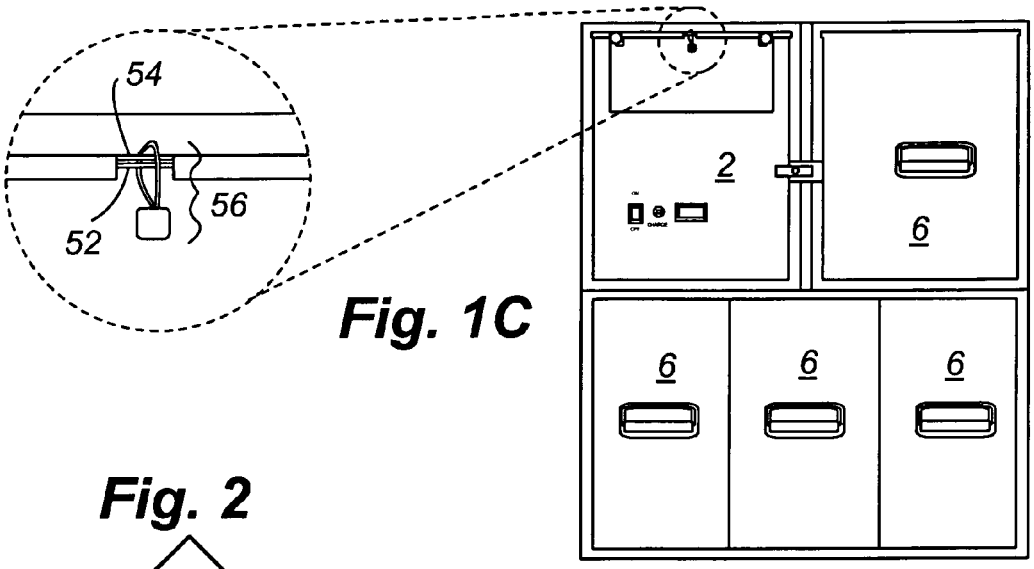
Fig. 1C
Fig. 2
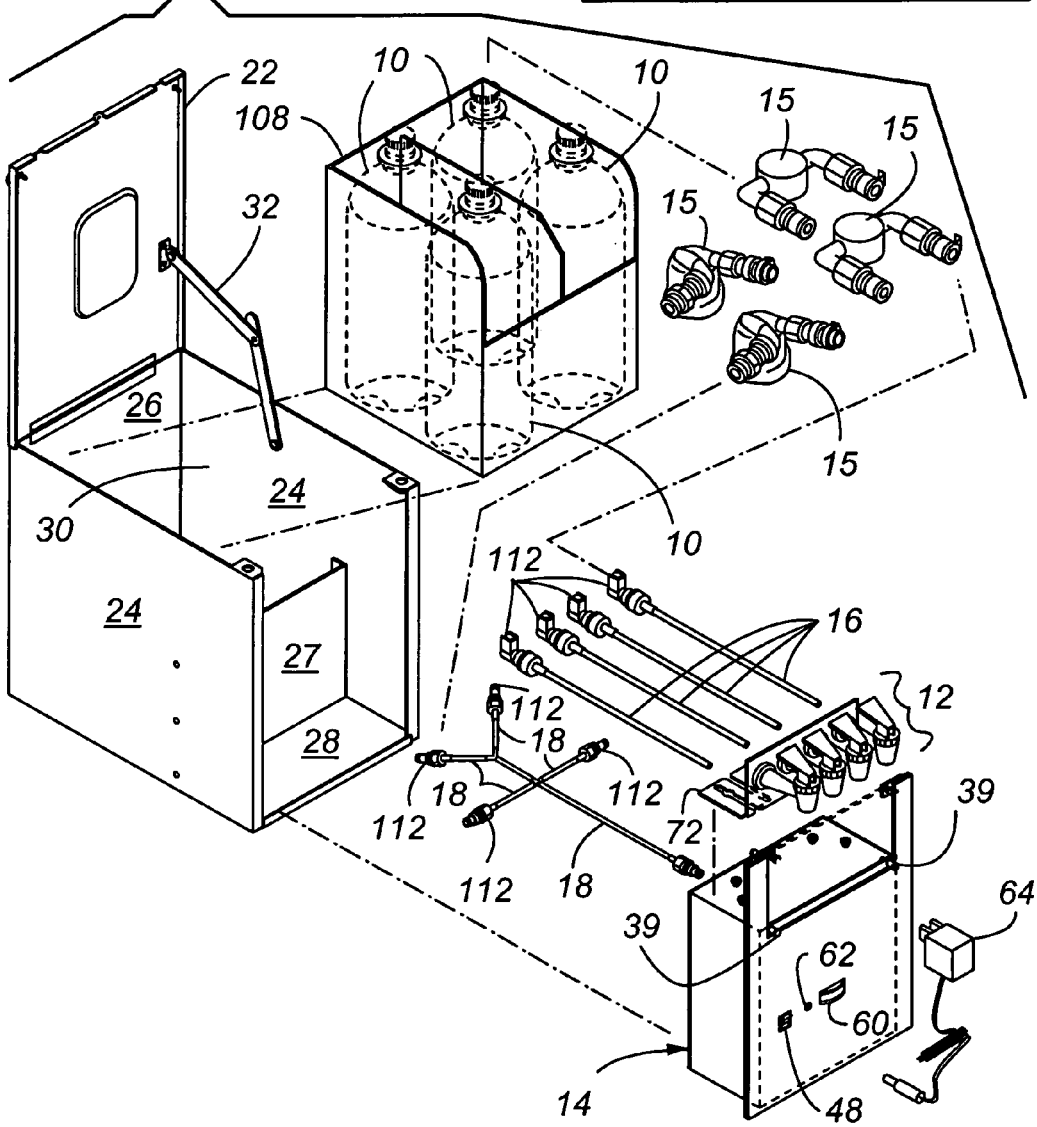

SELF-CONTAINED BEVERAGE DISPENSING APPARATUS

This non-provisional patent application claims priority from pending U.S. Provisional Patent Application, Ser. No. 60/471,120, entitled "SELF-CONTAINED BEVERAGE DISPENSING APPARATUS," filed on May 16, 2003, and which is herein incorporated by reference in its entirety.

FIELD OF THE INVENTION

The present invention generally relates to beverage dispensing systems configured for portable or fixed installations. More particularly, the present invention relates to a self-contained, beverage dispensing apparatus that is adapted for commercial and/or home use as an alternative to traditional canned beverage service.

BACKGROUND OF THE INVENTION

One sector which would particularly benefit from the use of the present invention is the airline industry. Beverage service aboard commercial aircraft has changed little over the last thirty years. Flight attendants for most airlines still wheel a mobile service cart filled with metal beverage cans up and down the aisles to provide beverage service to each passenger. However, the use of cans hampers the airlines' ability to offer more effective and efficient beverage service to their passengers.

A typical, major U.S. airline will use 50–60 million cans of beverages a year, a substantial portion of which are wasted. For example, most airlines end up throwing out 15–25% of their canned beverages. This is because passengers, on average, do not consume the entire amount of beverages in each can and, for less frequently requested drinks, like ginger ale, cans go stale before being fully used and/or even before they are actually served. Thus, there is a need for a beverage system that minimizes this waste by dispensing a variable amount of beverage to thereby satisfy individual customer needs while simultaneously ensuring that the existing beverage supply does not go flat or stale.

Using cans for this type of beverage service is extremely inefficient for several reasons. First, since cans are typically stored in trays on beverage carts, flight attendants are forced to search for the desired cans among a variety of possibilities. Time is wasted opening and closing such trays during the beverage service. On a plane carrying hundreds of passengers, the amount of wasted time can be significant. Moreover, the repetitive bending motion required to access these trays is also physically taxing on the flight attendants. Second, since there is not enough room in conventional airline service carts to store both food and beverage cans, flight attendants are forced to make at least two trips to distribute food and drinks to passengers—one trip down the aisle to distribute drinks and a second trip to deliver meals. Third, upon completion of the beverage service, flight attendants must take additional time to collect and dispose of the distributed cans, which takes away from time that could be devoted to catering to individual needs of the passengers (e.g., getting pillows, blankets, etc.) and/or performing additional safety-related tasks. Fourth, once the empty cans are collected, they must be stored until the airplane lands. This requires different storage space in addition to that used for the full cans. Full cans are neatly and efficiently stored in trays to minimize space requirements. Empty, or partially empty cans, on the other hand, are typically placed in trash bags without regard to efficient use of space. As a result, the trash typically uses two or more times the space taken up by full cans. Fifth, as previously mentioned, many of the beverage cans still contain some or a large portion of the beverage. This further complicates the disposal issue by requiring the cans to be placed in liquid tight containers and further necessitates additional cleaning of the disposal areas of the airplane galley due to inevitable spilled beverages. Thus, there is a need to minimize the amount of waste associated with a beverage service and optimize the amount of available storage space on an aircraft. There is also a need for a beverage dispensing system that reduces a flight attendant's workload and increases his/her productivity by eliminating the need to search for the desired beverages stored in the trays of a beverage cart. There is also a need to make airline beverage service more efficient by allowing the simultaneous distribution of meals and beverages. There is also a need to give flight attendants more time to attend to their other duties (e.g., safety and care of the passengers) by streamlining the distribution of beverages and eliminating the collection and disposal of cans upon completion of the beverage service. There is also a need to avoid dealing with partially consumed cans of beverage.

In light of the United States' heightened sense of national security, it has become imperative for airlines to be concerned about minimizing, to the extent possible, their exposure to terrorist activity. Since beverage cans are opaque, they are prime candidates to be filled with hazardous fluids without detection. While translucent beverage containers (e.g., clear plastic bottles) would substantially eliminate this risk, no known dispensing systems use these types of containers. Thus, there is a need for a beverage dispensing system, which is more easily inspected for tampering and poses less security risk. Further, there is a need for a beverage dispensing system which is adaptable for use with translucent containers such as clear plastic bottles. Still further, there is a need for a means to secure these beverage containers within the dispensing system in order to reduce the likelihood of tampering and/or to indicate that tampering has occurred.

Another problem with using cans on airplanes is that they can easily be adapted to be used as weapons. A person can twist a can in half, thereby creating two weapons with jagged edges. Such "impromptu" weapons are a problem because they can be created onboard without having to smuggle anything onto the plane, which further adds to the element of surprise. Thus, there is a need to remove cans from the beverage service on aircrafts in order to minimize exposure to possible terrorist activity.

While beverage dispensing systems have been developed for aircraft use, none dispense pre-mixed product from "off-the-shelf" containers. Rather, such systems are "post-mix" systems in that they use separate containers of syrup and water or carbonated water, which must be independently stored and interconnected for use. Moreover, the syrup and water containers tend to be large and cumbersome making changing of empty containers awkward while in-flight.

Known self-contained beverage systems, such as disclosed in U.S. Pat. No. 5,553,749 to Oyler et al., are reliant on cumbersome, opaque, and pressurized $CO_2$ canisters, which pose security risks similar to those described above. Further, this type of system requires special handling due to the pressurization of the $CO_2$ canister, which, if not handled properly, could cause catastrophic consequences in flight. For example, if the cap of the $CO_2$ cannister becomes dislodged during the flight, the canister would most likely act as a projectile or missile and cause serious bodily injury to one or more passengers or, worse still, puncture the skin of the aircraft—a result that could be fatal for everyone. Thus, there is a need for a beverage dispensing system that replaces canned beverage service without creating additional in-flight safety risks by relying on the use of highly pressurized tanks containing $CO_2$ or other gases. Similarly, there is a need for a beverage dispensing system that further minimizes the risk of tampering by not using opaque containers. There is also a need for a system that uses readily available pre-mix beverages in small, convenient, and off-the-shelf sizes.

Another problem with known systems, such as disclosed by Oyler et al., is that they cannot be retrofitted to existing fleets of beverage carts due to their size. Thus, an airline seeking to use a system of this type would need to replace its entire fleet of beverage carts, which would be quite costly. Indeed, there may be as many as 30–48 beverage carts used on a typical large passenger jet. Given the above-identified problems, and perhaps others, known post-mix beverage dispensing systems simply do not offer the cost savings to justify replacing existing fleets of airline beverage carts. Furthermore, existing beverage carts currently meet the airlines' needs. They are appropriately sized to easily move down the aisle of an airplane. The airplane galleys are all designed and constructed to securely hold these special carts and they have proven themselves reliable in years of service. Altering the cart design could have significant implications in other areas of airplane design and construction which, in turn, could be enormously expensive. Thus, there is a need for a beverage dispensing system that can be retrofit to existing fleets of service carts without any modification.

The present invention represents, among other things, an improvement over previous attempts at eliminating cans from conventional beverage service and is designed to overcome the aforementioned problems and other needs. As one ordinarily skilled in the art can appreciate, the present invention is not necessarily limited to use in an airline context, but is also envisioned to be used in any context in which it is desirable to replace canned beverage service and substitute a simple, convenient, efficient, and portable system for dispensing beverages. For example, the present invention could be used by railroads, bus lines, or cruise ships to provide beverages to their respective passengers. Moreover, the present invention can be adapted for use in a catering business, used at home, or rented out for use with private events. Similarly, the present invention could be used in connection with tailgating parties, school lunch services, or by restaurants. The present invention could also be used on golf carts to offer beverage service to golfers on a golf course. Still further, since the present invention removes the need to pour beverages from a bottle by hand, it could be easily used by handicapped or elderly individuals for their personal needs. These are but a few of the applications for the present invention. Such examples have been presented for purposes of illustration and in no way limit the use of the present invention. No doubt other uses will be apparent to those of skill in the art upon reading the present disclosure. All such end-uses are deemed to be within the spirit and scope of the present invention.

SUMMARY OF THE INVENTION

It is thus one aspect of the present invention to provide a self-contained beverage dispensing device that minimizes beverage waste associated with conventional canned service. In one embodiment, the beverage dispensing apparatus uses at least one valve (e.g., a tap or beverage gun) to dispense premixed beverages in precise amounts on an as needed basis while maintaining the carbonation, if appropriate, of the beverages, thereby creating cost savings.

It is another aspect of the present invention to improve the efficiency of aircraft beverage service to passengers by eliminating the need for flight attendants to search for particular beverage cans. In one embodiment, a plurality of valves (e.g., taps), which are interconnected to a plurality of different beverage containers, are conveniently and/or ergonomically positioned on the beverage dispensing apparatus in a central location.

It is another aspect of the present invention to improve the productivity of flight attendants by allowing for the simultaneous distribution of meals and beverages. In one embodiment, the beverage dispensing apparatus is of appropriate dimension to be fitted to the top surface of stock and/or customized airline beverage service carts of all sizes (e.g., in one embodiment, top surfaces up to 36" wide and 72" long) so that meals can be stored inside the carts and offered simultaneously with the dispensed beverages. This embodiment also negates the problem of having to replace and/or modify existing fleets of beverage carts in order to offer this type of dispensed beverage service.

It is another aspect of the present invention to provide a beverage dispensing system that reduces the amount of stored waste associated with traditional canned beverage service. In one embodiment, the beverage dispensing apparatus is not reliant on cans, which are typically distributed one to a passenger and which must be collected and stored until landing. Rather, in one embodiment, the present invention uses off-the-shelf beverage containers, such as 2 liter bottles, which hold more fluid per container than conventional cans, thereby substantially reducing the quantity of waste produced and virtually eliminating beverage waste.

It is another aspect of the present invention to minimize the risk of terrorist activity aboard an aircraft. In one embodiment, the beverage dispensing apparatus uses premixed, translucent beverage containers to help the user visually inspect the containers prior to usage.

It is another aspect of the present invention to provide a beverage dispensing system that can be locked and sealed for added security. In one embodiment, the beverage dispensing apparatus is adapted to be locked and sealed with an indicator mechanism (e.g., a lead and wire seal or other sealing device) which provides the user with an instantaneous way to identify if the dispensing system has been tampered with prior to use.

It is another aspect of the present invention to eliminate a means for creating a dangerous weapon aboard an aircraft. In one embodiment, the beverage dispensing system does not use cans, which are typically given to passengers and can be easily adapted into weapons. Rather, beverage containers, which are inaccessible by and positioned remotely from the passengers, are used.

It is another aspect of the present invention to increase the safety of a beverage dispensing system. In one embodiment, the beverage dispensing system uses compressed air at low pressure within individual beverage containers and the associated fluid lines to dispense beverages as opposed to relying on a highly pressurized $CO_2$ system. By using low pressure, compressed air, the system can use off-the-shelf beverage containers as opposed to more expensive, customized containers. Further, the system can use pre-mixed beverage products, which would also reduce costs.

It is another aspect of the present invention to provide a self-contained beverage dispensing apparatus that is of appropriate dimension to be stored within any stock or customized cargo compartment of a commercial aircraft (including, but not limited to, a compartment of up to 24" wide, 72" high, and 72" long). In one embodiment, the self-contained beverage dispensing system fits within a standard storage bin on an aircraft.

It is another aspect of the present invention to provide a beverage dispensing apparatus that uses dispensing means, which are less susceptible to tampering and breakage during pre-flight handling and in-flight storage, and offer easy, convenient, and multiple dispensing capabilities. In one embodiment, the present invention employs retractable dispensing members (e.g., taps, faucets, nozzles, etc.) that can be locked and stored inside the housing of the apparatus when not in use.

It is another aspect of the present invention to provide a beverage dispensing system that is portable, self-contained and small. In one embodiment, the beverage dispensing apparatus encases the necessary components and beverage containers to dispense beverages in a single, portable housing.

It is another aspect of the present invention to provide a beverage dispensing device that is easy to use. It is yet another aspect of the present invention to provide a dispensing system in which it is easy to change the containers used to supply the beverages. In one embodiment, the beverage dispensing system is activated by depressing a switch to pressurize the system and opening at least one valve to dispense the desired beverage. In one embodiment, the beverage dispensing system uses off-the-shelf bottles, which can be easily changed and disposed of as replacement beverage bottles are needed. In this embodiment, there is no need to mix individual components to create the desired beverage, thereby eliminating the need for large canisters of syrup, etc. As a result, a flight attendant can simply and quickly operate the system, and change the beverage containers used by the present invention without creating a mess. Further, there are no large or heavy empty containers to dispose and store.

BRIEF DESCRIPTION OF DRAWINGS

FIG. 1A is an isometric perspective view of one embodiment of the present invention in use with a standard aircraft beverage service cart;

FIG. 1B is an isometric perspective view of one embodiment of the present invention being stored in a conventional aircraft galley storage compartment;

FIG. 1C is a front elevation view of the embodiment shown in FIG. 1B with the storage compartment door open to allow access to the beverage dispensing apparatus;

FIG. 2 is an exploded view of one embodiment of the present invention;

Figure 3:
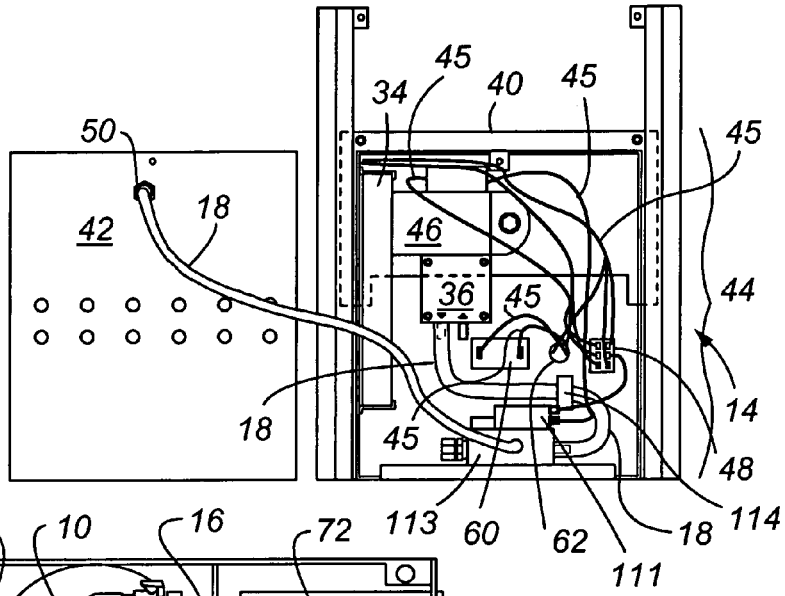
FIG. 3 is a rear elevation view of one embodiment of the control module in which the service panel has been removed.

The following components and numbers associated thereto are shown in the drawings and provided here for ease of reference:

| # | Component |
|---|---|
| 2 | Beverage Dispensing Apparatus |
| 4 | Beverage Service Cart |
| 6 | Airline Cargo Compartment |
| 8 | Housing |
| 10 | Beverage Container |
| 12 | Dispensing Mechanism |
| 14 | Control Module |
| 15 | Container Connection Member |
| 16 | Fluid Line |
| 18 | Air line |
| 20 | Handle |
| 22 | Top Panel |

-continued

| # | Component |
|---|---|
| 24 | Side Panel |
| 25 | Fastener |
| 26 | Rear Panel |
| 27 | Support Panel |
| 28 | Bottom Panel |
| 30 | Cavity of Housing |
| 32 | Support Member |
| 34 | Power Source |
| 36 | Pump |
| 37 | Air Intake Member |
| 38 | Front Panel of Control Module |
| 39 | Pin |
| 40 | Access Panel of Control Module |
| 42 | Service Panel of Control Module |
| 44 | Pneumatic Pump Sub-system |
| 45 | Electrical Wire |
| 46 | Motor |
| 48 | Activation Switch |
| 50 | Outlet Port |
| 52 | First Locking Mechanism |
| 54 | Second Locking Mechanism |
| 56 | Wire and Seal Assembly |
| 60 | Battery Charge Indicator |
| 62 | Battery Charging Port |
| 64 | Battery Charger |
| 66 | External Fluid Line |
| 68 | Connection Port |
| 70 | First End of External Fluid Line |
| 72 | Mounting Plate |
| 74 | Slot |
| 76 | Stop Member |
| 78 | Mouth |
| 80 | Tube |
| 82 | Air Inlet Port |
| 84 | Fluid Outlet Port |
| 86 | Second Container Connection Member |
| 88 | Fluid Inlet Port |
| 92 | Locking Member |
| 94 | Lip |
| 96 | Outer Member |
| 98 | Throat |
| 100 | Inner Member |
| 102 | Groove |
| 104 | Raised Protrusion |
| 106 | O-ring |
| 107 | Air Bleed Valve |
| 108 | Divider Member |
| 110 | Security Indicator Mechanism |
| 111 | Pressure Relief Valve |
| 112 | Quick Connection Member |
| 113 | Manifold |
| 114 | Check Valve |

DETAILED DESCRIPTION OF THE PREFERRED EMBODIMENT

The present invention recognizes the limited nature of traditional canned beverage service and offers, among other things, an improvement in terms of portability, safety, efficiency, customer satisfaction, and cost savings. While this invention is susceptible of embodiments in many different forms, there are, as shown in the drawings and will herein be described in detail, preferred embodiments of the invention. The reader is to understand that the present disclosure is to be considered as an exemplification of the principles of the invention and is not intended to limit the broad aspects of the invention to the embodiments illustrated.

Referring now to the drawings, FIG. 1A depicts an isometric side view of one embodiment of the beverage dispensing apparatus 2 in use with an airline beverage service cart 4. As can be appreciated by one skilled in the art, the beverage dispensing apparatus 2 can be made in varying heights according to the needs of the user. For example, if used on commercial aircraft, the housing must conform to certain Federal Aviation Administration ("FAA") dimension guidelines for storage purposes, i.e., must fit within existing galley storage compartments 6 which may vary from plane to plane. In larger commercial jets, these compartments measure approximately 18 inches in length, 14 inches in width, and 15 inches in height. See FIGS. 1B and 1C depicting the present invention stored in an airline galley storage compartment 6 with a door removed for purposes of illustration. Similarly, in one embodiment, the base or footprint dimensions of the beverage dispensing apparatus 2 are no greater than those of the top work surface of a standard airline beverage service cart (i.e., must be no wider than 14 inches and no longer than 34 inches). Thus, in an airline context, in one embodiment, the beverage dispensing apparatus 2 preferably is comprised of the following dimensions: approximately 13" in height, 10" in width and 15" in length in order to meet these requirements. If the present invention is used in other applications, such as at home, for example, it may be desirable to adjust the height of the system to fit on top of a counter or bar, or beneath a sink. Regardless of the end use location, in one embodiment, the beverage dispensing apparatus 2 is preferably of sufficient height to encase a standard 2 liter plastic beverage bottle.

Moreover, it is also envisioned that, in one embodiment, the beverage dispensing apparatus 2 is of appropriate dimension so that at least two beverage dispensing apparatuses 2 can be positioned back-to-back on top of a beverage cart. This configuration would allow different types of beverages to be concurrently served by one cart and/or the identical beverages to be served to rows of passengers on both sides of the cart, thereby accelerating the beverage service. In one embodiment, the present invention is also of appropriate dimension so that multiple (e.g., two sets of two systems) beverage dispensing apparatuses 2 could be stacked within the storage area of the beverage cart. This would facilitate storage of the devices as well as offering a longer duration of beverage service without having to stop to change empty beverage containers (and without having to deal with can disposal).

Turning now to FIG. 2, in one embodiment, the beverage dispensing apparatus 2 is generally comprised of a housing 8, one or more beverage containers 10, one or more dispensing mechanisms 12 (e.g., valve, tap, gun, etc., or any combination thereof), a control module 14 to move beverages from their containers to the dispensing mechanism(s) 12, one or more container connection members 15, and at least one fluid line 16 and air line 18 to carry pressurized air and fluid used by the beverage dispensing apparatus 2.

In one embodiment, the housing 8 encases all of the necessary components to dispense beverages from premixed beverage containers 10, thereby making the present invention highly portable. Various types of handles 20 may be interconnected to the housing 8 to facilitate portability. For example, as shown in FIG. 1B, in one embodiment, the handle is integrated into and flush with a top panel 22 of the housing 8. In one embodiment, the handle 20 may be biased in a recessed or closed position in order to ensure that handle 20 does not interfere with or disrupt use or storage (see FIG.

1B). Of course, other types of handles could interconnected to or integrated into the housing 8 at conveniently positioned points (e.g., in opposable fashion on side panels 24 of the housing 8), all of which are within the spirit and scope of the present invention.

As shown in FIG. 2, in one embodiment, the housing 8 is further comprised of, among other things, the top panel 22, a rear panel 26, a support panel 27, a bottom panel 28, and opposable side panels 24. In one embodiment, the top panel 22 is used to access the interior of the dispensing apparatus for purposes of service and replacement of beverage containers 10 and associated fluid components encased by the housing 8. Preferably, the top panel 22 is hinged to the housing 8 to facilitate this process and, in one embodiment, may be secured to the housing 8 via a pair of selectively lockable fasteners 25 for security purposes. This is particularly advantageous in an airline context in which security issues are paramount. In one embodiment, the top panel 22 is hinged in such a manner so that the top panel 22 can swing upward and away from the housing 8 to reveal a cavity 30 for inserting at least one beverage container 10. As one ordinarily skilled in the art can appreciate, however, the present invention is envisioned to encompass other means of accessing the beverage containers 10. For example, a hinged or sliding rear panel 26 could be used in lieu of the top panel 22 in order to gain access inside the housing 8 to stock and replace the beverage containers 10 on an ad hoc basis. Similarly, the top panel 22 could be slidably interconnected to the housing 8 or completely detachable. The side panels 24 of the housing 8 could also be hingedly or slidably interconnected to the housing 8, alone, or in combination so that the beverage containers 10 could be accessed. Various access panels could be integrated into any or all of the sides of the housing. The combinations are limitless, all of which are intended to be within the spirit and scope of the present invention.

In one embodiment, it may be preferable to include a lockable support member 32 interconnected to the top panel 22 and one of the side panels 24 in order to support the top panel 22 in an upright position. See, e.g., FIG. 2. This configuration also frees up the hands of the user when changing a beverage container 10.

The housing 8 can be made in various shapes and sizes, and made out of a variety of lightweight, durable materials and still be within the spirit and scope of the present invention. For example, the housing 8 can be comprised of sheet metal, aluminum, plastic, or other resilient material, or a combination thereof. The housing 8 can also be manufactured in a single piece construction or in multiple parts, which can be disassembled for easy cleaning and maintenance. Optionally, the housing 8 can be insulated or double-walled so that ice can be added to chill the encased beverage containers 10 or to maintain the temperature of cold or hot beverages.

Referring now to FIG. 3, one embodiment of the control module 14 is depicted. In one embodiment, the control module 14 is a self-contained module, which can be removed from the housing 8 for servicing and/or replacement. It is also advantageous for the control module 14 to be self-contained and removable so that the inner cavity of the housing 30 can be cleaned without causing any harm to any of the electrical components contained in the control module 14 (e.g., power source 34, pump 36, etc.). Preferably, in one embodiment, the control module 14 is further comprised of a front panel 38, an access panel 40, a service panel 42 (which may be removed to access, service, and/or replace the components contained therein), and a pneumatic pump sub-system 44, which facilitates the dispensing of carbonated and/or non-carbonated beverages, alone or in combination. See FIGS. 2 and 3.

In one embodiment, the pneumatic pump sub-system 44 facilitates the dispensing of carbonated and/or non-carbonated beverages, alone, or in combination. Regardless of the type of beverage used, in one embodiment, the pneumatic pump sub-system 44 is used to pressurize air lines 18 and fluid lines 16 running between the pump 36, the dispensing mechanisms 12, and container connection members 15. In one embodiment, the pneumatic pump sub-system 44 is further comprised of the pump 36 (which is preferably pneumatic) in electrical communication with a motor 46; the power source 34 (e.g., a battery) that activates the motor 46; an activation switch 48 interconnected to the motor 46; and an outlet port 50 to direct pressurized air via an air line 18 from the pump 36 ultimately to the beverage containers 10. Of course, it is also envisioned that the pneumatic pump sub-system 44 may comprise fewer or additional elements than those described above and still be within the spirit and scope of the present invention.

In one embodiment, the front panel 38 is used to access means for selectively dispensing the beverages (i.e., dispenser mechanism 12 such as a tap, faucet, spout, valve, gun, etc.), which are moveable between a retracted or stowed position and an extended position relative to the housing 8. As previously noted, in one embodiment, the front panel 38 of the control module 14 is further comprised of the access panel 40. The access panel 40 preferably has at least two operable positions of use: (1) a first position of storage in which the access panel 40 can be selectively locked to the top panel 22 of the housing 8 for security purposes (see FIG. 1C) and (2) a second retracted position in which the access panel 40 is lowered within the housing 8 so that the user can access the stored dispensing mechanism(s) 12 (e.g., a plurality of taps), which slide in and out from the housing 8. See FIGS. 1A and 1B, and further discussion below. In one embodiment, when the access panel 40 is in a first position of storage, it is further comprised of a means for securing it to the front panel 38, such by a set of biased pins 39. See, e.g., FIG. 1B. As one ordinarily skilled in the art can recognize that are various ways in which the access panel 40 can be configured and secured to the front panel 38, all of which are intended to be within the spirit and scope of the present invention. For example, the access panel 40 can be hingedly interconnected to the front panel 38 of the control module 14. In this configuration, the access panel 40 would be lowered downward toward the front panel 38 to reveal the dispensing mechanism(s) 12. In one embodiment, the access panel 40 can also be secured in an upward position against the front panel 38 during non-use by a padlock assembly.

Similarly, for added security, in one embodiment, the access panel 40 may be fitted with a first locking mechanism 52, which may be interconnected to a second locking mechanism 54 located on the top panel of the housing 8, so that the housing 8 can be locked prior to use. Various types of locking means could be employed and are envisioned to be within the spirit and scope of the present invention. For example, a hook and latch assembly could be used, alone, or in combination with a combination lock or padlock. In addition to conventional locks, more expensive, digital locks, or locks using fingerprint or other biological scanning technology (e.g., retinal) are also envisioned to be within the spirit and scope of the present invention. Similarly, in one embodiment, two loops may be positioned in opposable communication. As shown in FIG. 1C, a first loop (i.e., first locking mechanism 52) on the top panel 22 of the housing 8 is positioned in opposable communication to a second loop (i.e., second locking mechanism 54) on the access panel 40 of the front panel 38 of the control module 14. In this configuration, the first loop 52 and second loop 54 can be interconnected via a conventional wire and lead seal assembly 56. See, e.g., FIG. 1C. Similarly, in one embodiment, loops could be strategically positioned on the side panels 24 as well in order to lock the side panels 24 to the top panel 22 or front panel 38. It is envisioned that a tracking number could be associated with such a wire and seal assembly 56, thereby providing a heightened level of security.

The particular size and power of the pump 36 of the present invention may vary as both measures will depend, among other things, on the size and number of beverage containers 10 to be used in conjunction with the present invention as well as the desired flow rate. In one embodiment, a 12 volt DC pump 36 provides the necessary pressure to maintain the carbonation of the beverage within the beverage containers 10 while ensuring adequate flow through the dispensing mechanism(s) 12. As one ordinarily skilled in the art will recognize, the pump 36 can ultimately communicate with the container connection members 15 through the single port 50 shown in FIG. 3 or via a manifold of multiple connections, which are integrated into the service panel 42 of the control module 14. Similarly, as one skilled in the art will appreciate, the type and strength of fluid lines 16 and air lines 18 used will depend on the requisite pressure needed to run the beverage dispensing apparatus 2. In one embodiment, the air lines 18 and fluid lines 16 are made out of transparent material in order to more easily identify the cause of any resulting blockages.

As shown in FIG. 3, in one embodiment, the power source 34 is a battery, which is preferably rechargeable to ensure greater performance time without the need for service. Of course, one or more non-rechargeable batteries could also be used, alone or in combination, with their rechargeable counterparts. Regardless, using a battery increases the portability of the beverage dispensing apparatus 2, which is especially desirable in an airline context where the beverages are brought to the consumers rather than the consumer moving to a stationary beverage dispenser (such as at a bar). In order to keep track of the remaining charge of the battery, in one embodiment, the front panel 38 is further comprised of a battery charge indicator 60 and/or a battery charging port 62, which can be selectively interconnected to a battery charger 64. See FIG. 2.

While it is advantageous to power the present invention via a battery so that the self-contained apparatus is more portable, it is also envisioned that the present invention could be interconnected to an alternative power source to drive the pump. Accordingly, in one embodiment, the beverage dispensing apparatus 2 is further comprised of a port for interconnecting a corded plug for use with an automobile cigarette lighter assembly. Of course, a corded plug could also be integrated into the housing 8 to accomplish the same result. Moreover, it is envisioned that the present invention could also be powered by a DC power source (non-rechargeable) or an AC power source (e.g., an electrical outlet).

Figure 4A:
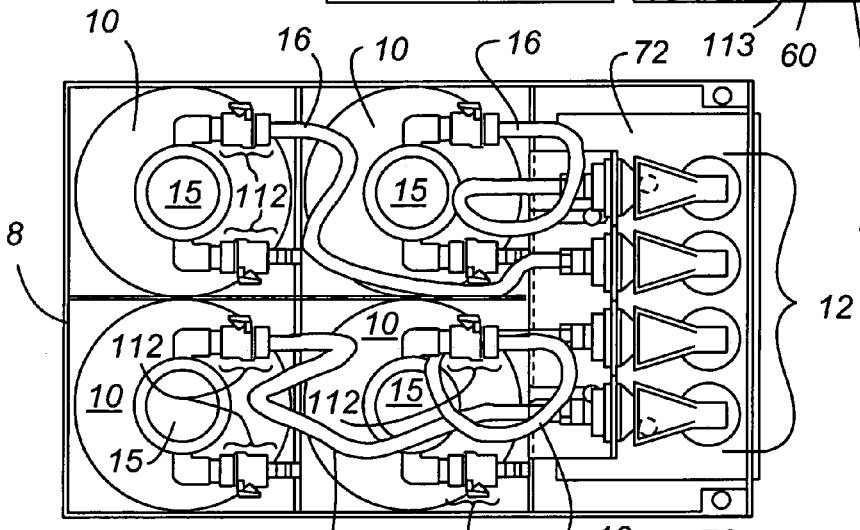
FIG. 4A is a plan view of one embodiment of the present invention in which the top panel is removed and the interconnected fluid lines are shown, and the dispensing mechanism is shown in a storage or recessed position.
Figure 4B:
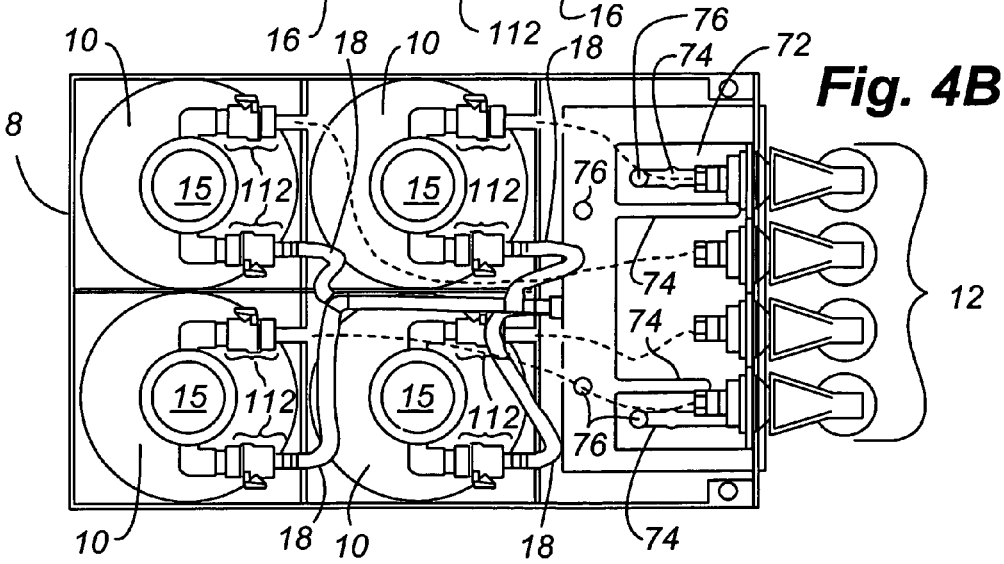
FIG. 4B is a plan view of one embodiment of the present invention in which the top panel is removed and the interconnected air lines are shown, and the dispensing mechanism is shown in an extended or operating position.
Figure 4C:
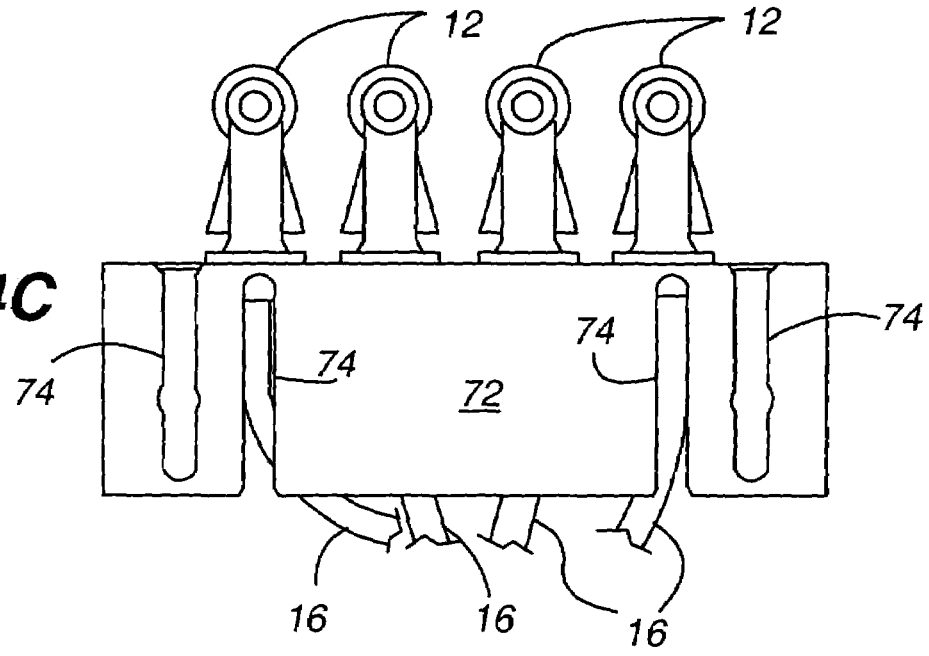
FIG. 4C is a bottom view of one embodiment of the mounting plate and dispensing mechanism.

Referring now to FIGS. 4A and 4B, the dispensing mechanism 12 of the present invention will be discussed. As one skilled in the art will appreciate, there are a variety of ways to dispense the desired beverage in a controlled manner (e.g., a two-way valve, a tap, a faucet, a gun, etc.) from the housing 8 of the beverage dispensing apparatus 2, all of which are intended to be within the spirit and scope of the present invention. Similarly, it is understood that one or more dispensing mechanisms 12 can be used in connection with the current invention. Thus, the term "dispensing mechanism," as used throughout, is intended to refer to one and/or more dispensing devices. Preferably, in one embodiment, the dispensing mechanisms 12 are a plurality of taps so that more beverage choices can be concurrently offered, dispensed, and served, and more than one user can operate the beverage dispensing apparatus at one time. See FIGS. 1A, 2, 4A and 4B. However, a single tap could be interconnected to and in fluid communication with more than one container connection member 15 and still be within the scope of the present invention. In this embodiment, it is envisioned that a series of valves could be manipulated by an assembly interconnected to the housing 8 to divert fluid from a particular container connection member 15 to a particular tap.

Figure 5:
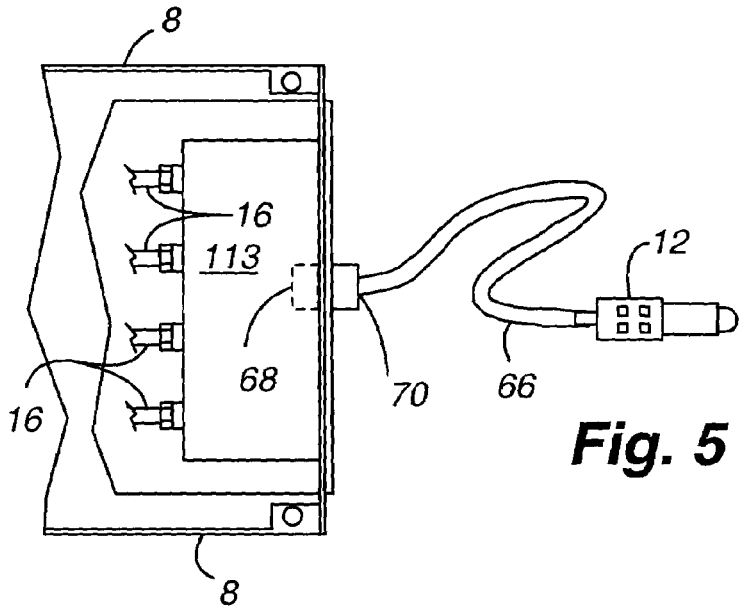
FIG. 5 is a partial plan view of one embodiment of the present invention in which a dispensing gun is interconnected via a manifold to a plurality of fluid lines.

Similarly, in one embodiment, the dispensing mechanism 15 comprises a beverage gun interconnected to an accompanying external fluid line 6 and a connection port 68 (preferably a female type, although a male type port could be used) integrated into the housing 8. See, e.g., FIG. 5. Use of the connection port 68 addresses the same concern about damaging the dispensing mechanism 12 of the present invention while in storage or transit. In one embodiment, the user interconnects a first end 70 of the external fluid line 66 to the connection port 68 and then, using the gun, begins to dispense the desired beverage contained within the housing 8 by depressing a button on the gun. Thus, in one embodiment, each button on the gun corresponds to each type of desired beverage. See, e.g., FIG. 5. In the alternative, a separate gun and corresponding connection port 68 could be used for each desired beverage. Regardless, it is intended that the gun can dispense a plurality of types of carbonated and non-carbonated beverages. Further, the present invention is not limited to the use of any particular type of dispensing mechanism 12, but rather is intended to cover all combinations of different types of dispensing mechanisms 12.

Figure 4D:
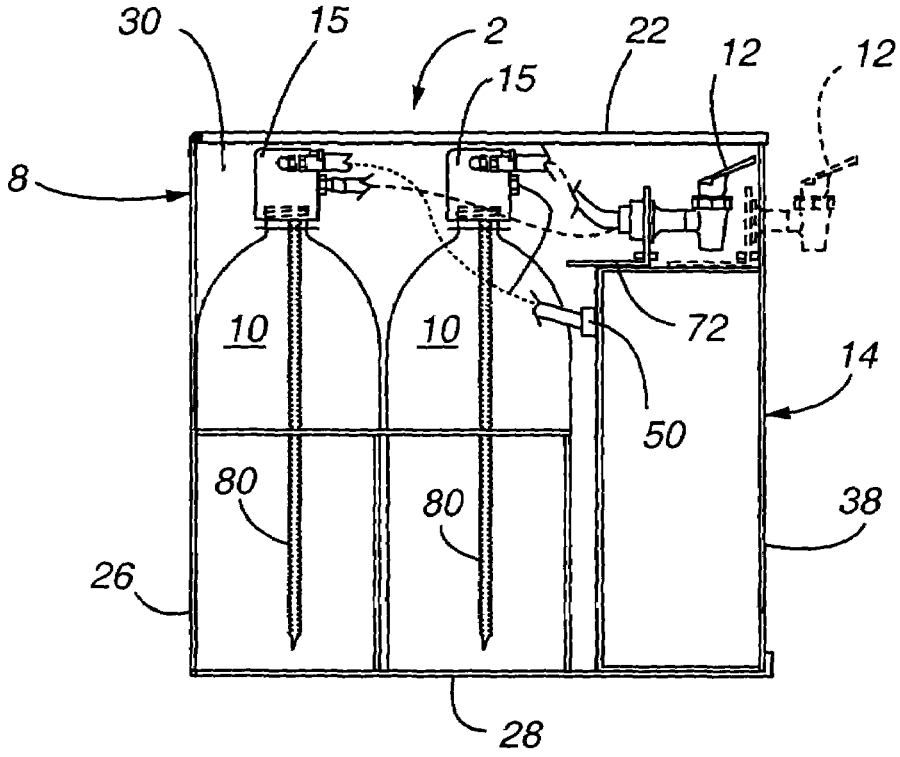
FIG. 4D is a side elevation view of one embodiment of the present invention with a side panel removed and illustrating the first and second positions of the dispensing mechanism.

As noted above, in one embodiment, the dispensing mechanism 12 (e.g., tap) slides out of the housing 8 in order to be used. To effectuate this action, in one embodiment, the dispensing mechanism 12 is interconnected to a mounting plate 72, which is slidably attached to the control module 14, as shown in FIGS. 2 and 4A–4C. In one embodiment, the mounting plate 72 is further comprised of at least one slot 74 (in FIG. 4D in which four slots 74 are shown), which selectively communicates with at least one stop member 76 (e.g., a pin as shown in FIG. 2) that prevents the mounting plate 72 and dispensing mechanism 12 from being hyperextended from the beverage dispensing apparatus 2. Similarly, the stop member 76 prevents the mounting plate from being pushed too far into the housing 8 during storage. See, e.g., FIG. 4B.

As one ordinarily skilled in the art will understand, there are a myriad of ways to effectuate the sliding action of the dispensing mechanism(s) 12, all of which are intended to be within the spirit and scope of the present invention. In one embodiment, the dispensing mechanism 12 is interconnected to opposably mounted tracks that are either mounted on the top panel 22 or side panels 24 of the housing 8. In one embodiment, each of the tracks are hingedly interconnected at their respective forward ends so that the tracks can be swung upward and away from the beverage containers 10 to facilitate replacement of the containers 10.

As one skilled in the art will appreciate, the dispensing mechanism 12 does not have to be in slidable engagement with the housing 8, although this configuration guards against accidental damage incurred during storage or while in transit. Rather, in one embodiment, the dispensing mechanism 12 is interconnected to the outside of the housing 8 and is protected by an optional robust cover, which is hingedly or removably interconnected to the housing 8. This configuration also addresses concerns about damage during storage or while in transit.

Figure 8A:
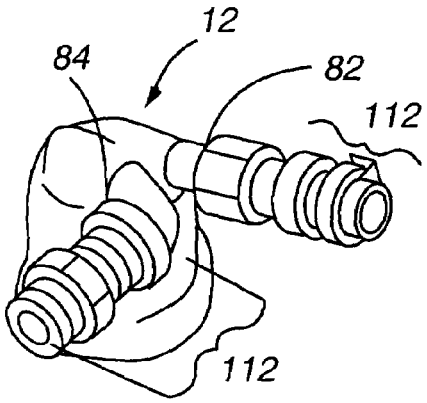
FIG. 8A is an isometric perspective view of another embodiment of the container connection member.
Figure 8B:
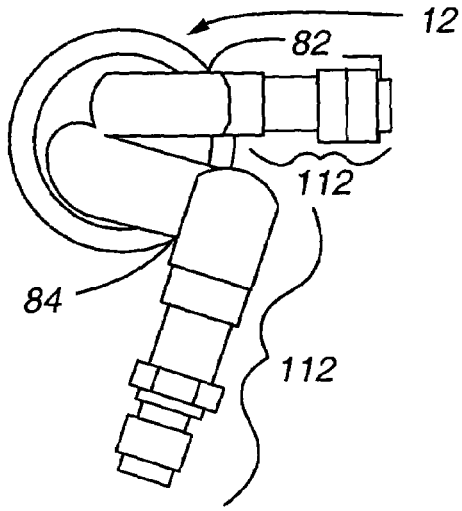
FIG. 8B is a plan view of the container connection member shown in FIG. 8A.
Figure 8C:
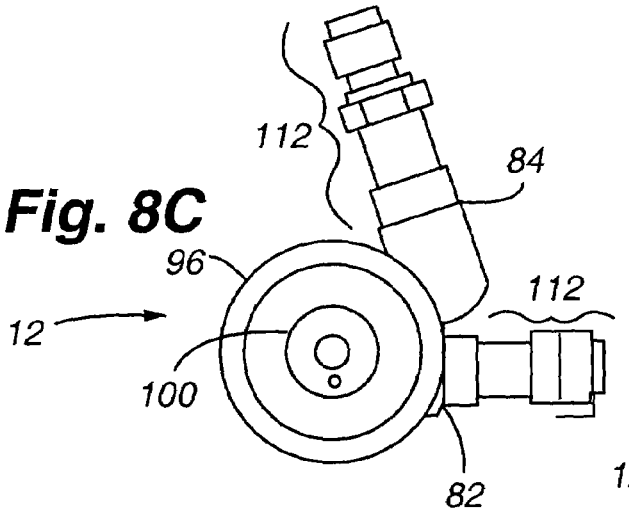
FIG. 8C is a bottom view of the container connection member shown in FIG. 8A.
Figure 8D:
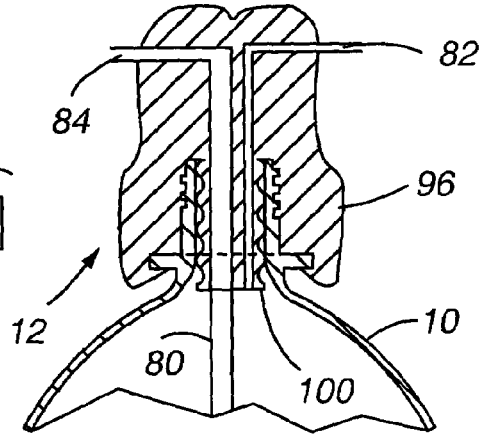
FIG. 8D is a cross-section view of the container connection member shown in FIG. 8A attached to a beverage container.
Figure 8E:
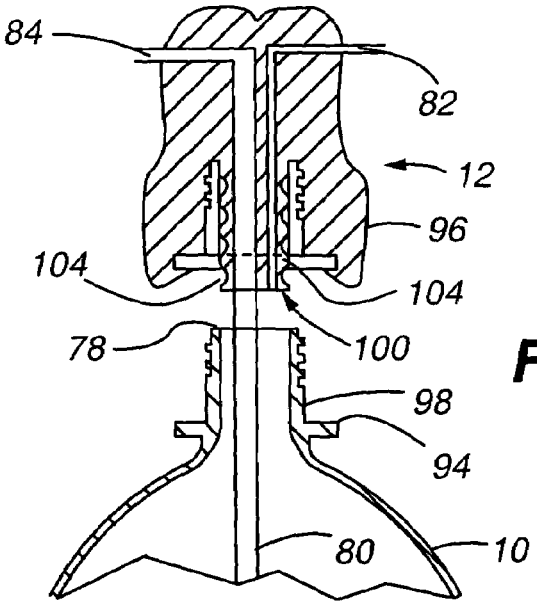
FIG. 8E is a cross-section view of the container connection member shown in FIG. 8A spaced above a beverage container.

In order to retrieve the desired beverage from the beverage container 10, in one embodiment, the container connection member 15 is a removable cap that is positioned over a mouth 78 of the beverage container 10. In one embodiment, the number of container connection members 15 directly corresponds to the number of beverage containers. See, e.g., FIGS. 4A and 4B. In one embodiment, the container connection member 15 is further comprised of a tube 80, an air inlet port 82, and a fluid outlet port 84. See, e.g., FIG. 8E. Once the container connection member 15 is positioned over the mouth 78 the beverage container 10, the tube 80 facilitates the flow of beverage from a bottom of the container 10 through the container connection member 15 and out to the corresponding beverage dispensing member 15 (e.g., tap). In the preferred embodiment, each container connection member 15 is in fluid communication with a corresponding dispensing mechanism (i.e., in parallel). Nonetheless, it is also envisioned that multiple container connection members 15 can be connected in fluid communication with a single beverage dispensing member 15.

Figure 6:
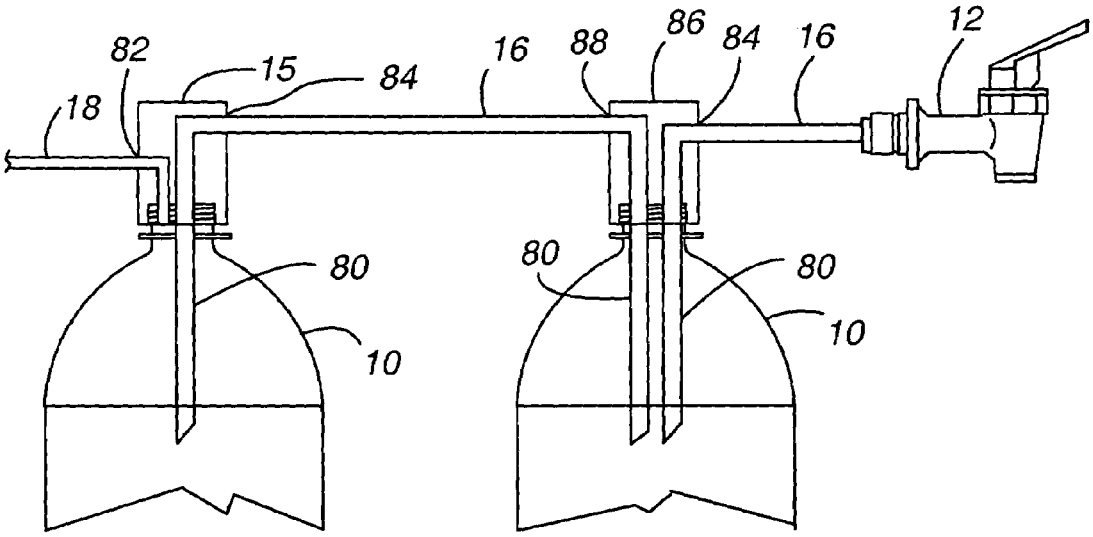
FIG. 6 is a side elevation view of one embodiment of the current invention in which beverage containers are connected in series.

Similarly, in one embodiment, several beverage containers 10 are operatively attached in series so that a larger volume of a more popular drink is provided without having to replace empty beverage containers as frequently. See, e.g., FIG. 6. In this embodiment, at least two different types of container connection members 15 are employed. In one embodiment, the first container connection member 15 is akin to that described above in that it has, among other things, an air inlet port 82 and a fluid outlet port 84. In one embodiment, the second container connection member 86 is comprised of, among other things, a fluid inlet port 88 and the fluid outlet port 84, both of which may be used to transport pressurized air or fluid on an as needed basis. In one embodiment, the air inlet port 82 of the first container connection member 15 is operatively interconnected to the pump 36. The fluid outlet port 84 of the first container connection member 15 is operatively interconnected to the fluid inlet port 88 of the second container connection member 86, as shown in FIG. 6. In one embodiment, the fluid outlet port 84 of the second container connection member 86 is operatively interconnected to the fluid inlet port 88 of the next container connection member in the series. This progression continues until the last container connection member 15 is connected, in which the respective fluid outlet port 84 is operatively interconnected to and in fluid communication with the corresponding beverage dispensing mechanism 15 (e.g., tap). As a result, pressurized air drives fluid from one beverage container 10 to the next until all of the containers 10 (e.g., bottles) are emptied. As one skilled in the art can appreciate, this "series" configuration can be used, alone, or in combination with the "parallel" system described above and still be within the spirit and scope of the present invention.

In addition, the container connection member 15 can take various other forms, all of which are within the spirit and scope of the present invention and generally have the characteristics of providing means for allowing pressurized air to enter the beverage container 10 and fluid to leave the container 10. In one embodiment, the container connection member 15 is further comprised of an air bleed valve 107 so that the user can safely release any pressurized air from the respective air line 18 associated with that particular beverage container 10, which facilitates replacement and/or removal of the beverage container 10.

Figure 7A:
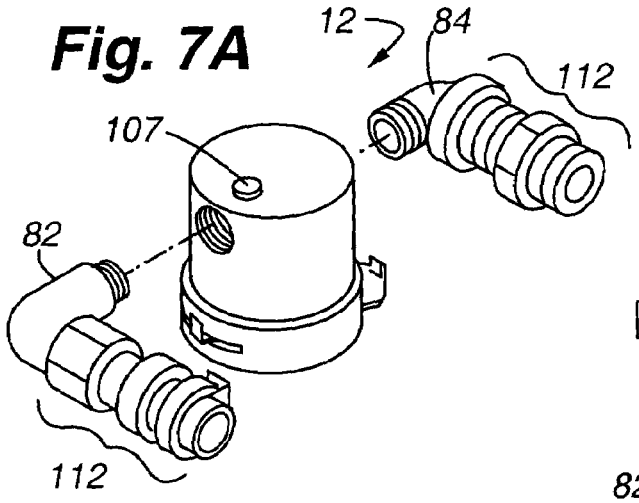
FIG. 7A is an isometric perspective view of one embodiment of the container connection member.
Figure 7B:
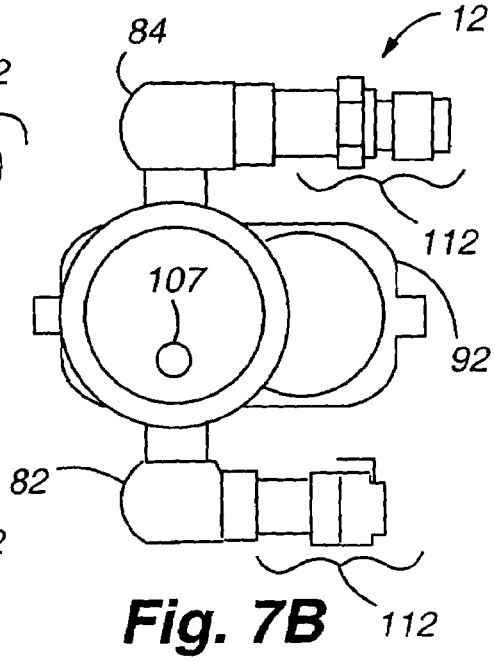
FIG. 7B is a top plan view of the container connection member shown in FIG. 7A.
Figure 7C:
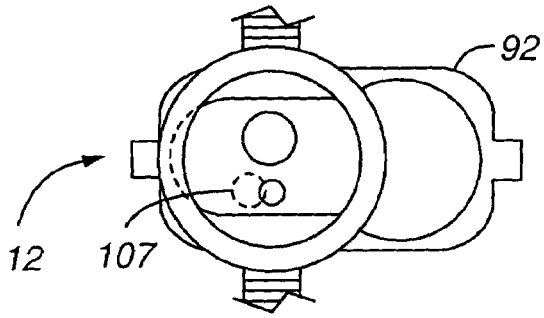
FIG. 7C is a bottom plan view of the container connection member shown in FIG. 7A.
Figure 7D:
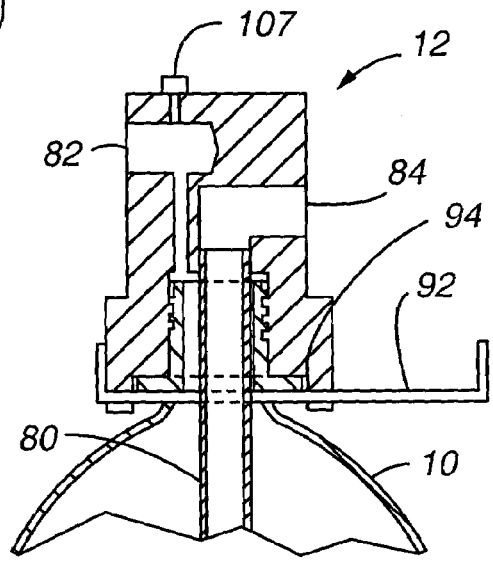
FIG. 7D is a cross-sectional view of the container connection member shown in FIG. 7A and connected to a beverage container with the locking mechanism in a locked position relative to the beverage container.
Figure 7E:
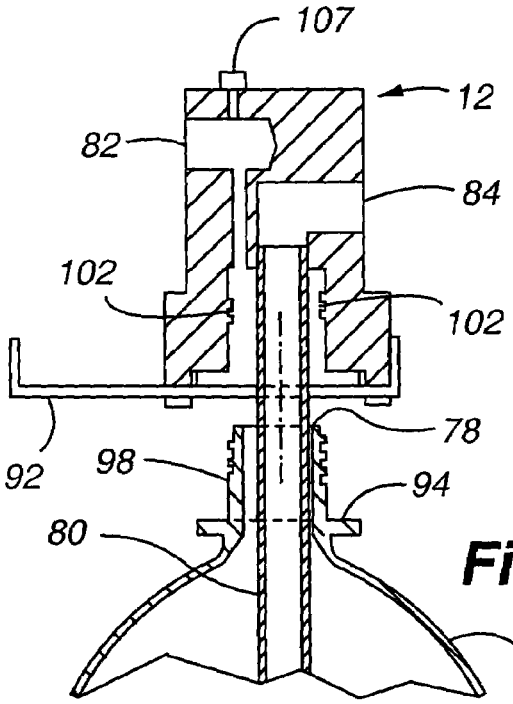
FIG. 7E is a cross-sectional view of the container connection member shown in FIG. 7A and spaced above a beverage container with the locking mechanism in an unlocked position permitting attachment or detachment relative to the beverage container.

In order to ensure that the container connection member 15 does not become dislodged while in use, storage, or transit and to facilitate maintaining a proper/effective seal, in one embodiment, in one embodiment, the container connection member 15 is further comprised of a locking member 92, which, among other things, grips a lip 94 of the beverage container 10. See, e.g., FIG. 7D for an unlocked position of use and FIG. 7E for a locked position of use. As one ordinarily skilled in the art will appreciate, the locking member 92 can be made in various forms and still be within the spirit and scope of the present invention. See, e.g., FIGS. 7C and 7B for one embodiment of the locking member 92.

In one embodiment, the container connection member 15 is further comprised of a pliable outer member 96 (see, e.g., FIGS. 8A–8E), which is seated around the throat 98, and an inner member 100 that fits within the throat 98. Since this embodiment is preferably pliable, the outer member 96 can universally conform to "wide mouthed" throats 98 or conventional throats 98 in order to accommodate a full spectrum of beverage containers 10.

Figure 9A:
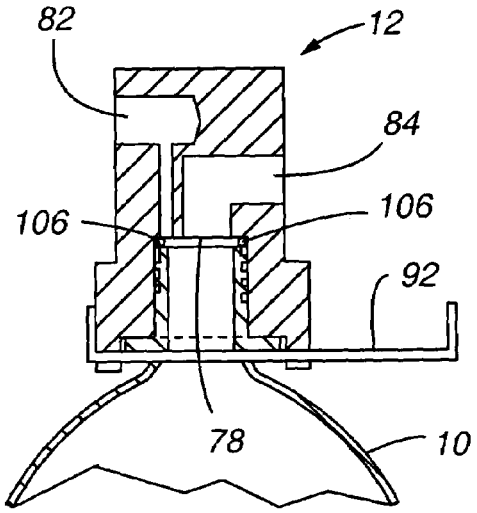
FIG. 9A is a cross-sectional view of one embodiment of the container connection member of FIG. 7A, further illustrating an o-ring sealing against a mouth of the beverage container.
Figure 9B:
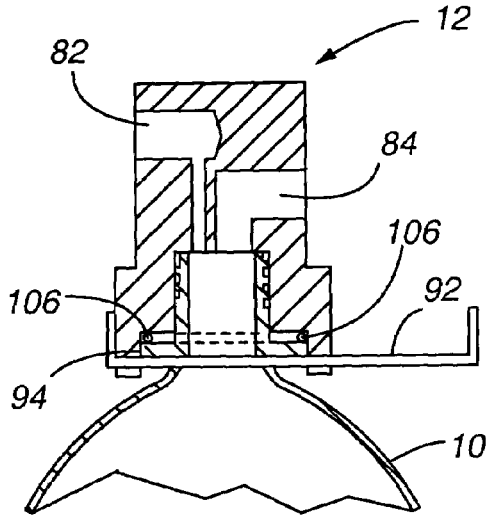
FIG. 9B is a cross-sectional view of one embodiment of the container connection member of FIG. 7A, further illustrating an o-ring sealing against a lip of the beverage container.

As noted above, the container connection member 15 of the present invention can be modified to include many different features, which may be included alone or in combination. In one embodiment, the container connection member 15 is further comprised of grooves 102, which allow the beverage connection member 15 to be turned around the throat 98 of the beverage container 10. See, e.g., FIG. 7E. In one embodiment, the container connection member is further comprised of a inner member 100 with raised protrusions 104, which are inserted within and grip against the throat 98 of the beverage container 10. See, e.g., FIGS. 8D and 8E. In one embodiment, the container connection member 15 is further comprised of an o-ring 106 which seals the container connection member 15 against the container 10 at the lip 94 of the container 10. See, e.g., FIG. 9B. In one embodiment, the container connection member 15 seals against the mouth 78 of the beverage container 10. See, e.g., FIG. 9A. In addition, in one embodiment, the container connection member 15 is further comprised of a gripping member (e.g., a self-locking swing assembly used with certain types of beer bottles), which can selectively secure the container connection member 15 against the lip 94 of the beverage container 10. In this embodiment, the pressure inside the beverage container 10 assists in securing the container connection member 15 to the lip 94 of the beverage container 10. In one embodiment, the container connection member 15 is further comprised of the air bleed valve 107 (see, e.g., FIG. 7A), which is interconnected to or integrated into the container connection member 15 (e.g., into the locking member 92) and eliminates the need to depressurize all of the air lines 18 and fluid lines 16 in order to replace just one beverage container 10. In one embodiment, the air bleed valve 107 is incorporated into the locking member 92.

Figure 10A:
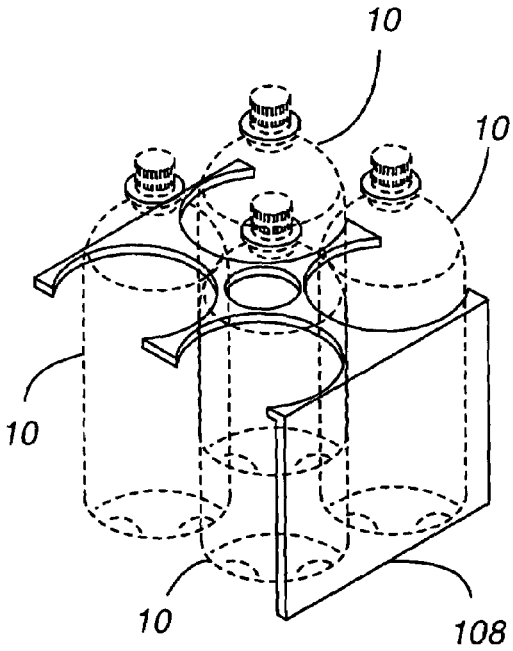
FIG. 10A is an isometric perspective view of one embodiment of a divider member of the present invention in use with beverage containers.
Figure 10B:
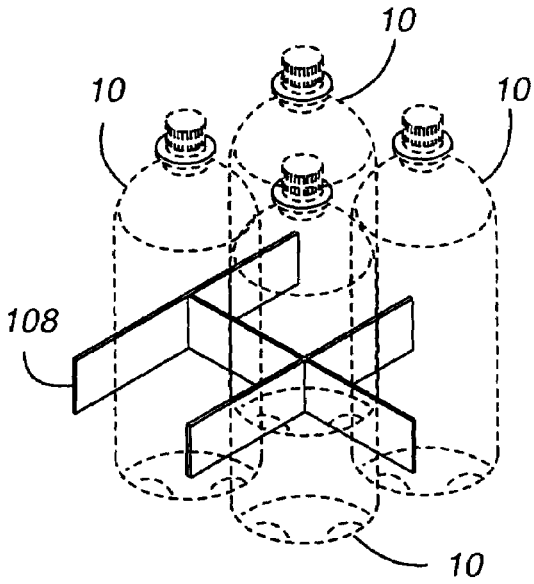
FIG. 10B is an isometric perspective view of another embodiment of a divider member of the present invention in use with beverage containers.

In order to provide additional stability to the present invention, in one embodiment, a divider member 108 may be permanently or removably interconnected inside the housing 8 so that the encased beverage containers 10 remain in an upright position while in storage, transit and use. As shown in FIGS. 10A and 10B, the divider member 108 can be made in various shapes to accommodate the type of beverage container used in the present invention. In addition, in one embodiment, the divider member 108 can be a box that is used to stabilize and transport the beverage containers 10. See, e.g., FIG. 2. This embodiment eliminates the need for ramp service on snack flights as the boxes with beverage containers 10 can be replaced by customer service agents, thereby cross-utilizing existing labor. While the box can be made out of any material, in one embodiment, it is preferable that it be constructed out a lightweight and durable material, such as cardboard.

Operation of the present invention will now be discussed. In order to prepare the present invention for use, in one embodiment, the hinged top panel 22 is lifted away from the housing 8 and beverage containers 10 (e.g., 2 liter plastic soda bottles) are placed inside the housing 8. Container connection members 15 are positioned over the mouths 78 of the beverage containers 10 and the top panel 22 is lowered back into its original position. The access panel 40 is slid upward toward the top panel 22 and secured against the top panel 22 via the first and second locking mechanisms 52, 54. Optionally, in order to instill an additional level of security, in one embodiment, a security indicator mechanism 110 (e.g., a paper seal or wire and seal assembly 56) is interconnected to a seam where the front panel 38 and the top panel 22 meet. See, e.g., FIG. 1C. This way, if the security indicator mechanism 110 is broken and/or damaged prior to use, then the user knows that beverage dispensing apparatus 2 has been tampered with prior to use (e.g., take off) and can take the necessary corrective measures. Of course, as noted above, other visual or audio indicator means can be employed in conjunction with the present invention to display/indicate whether or not any unauthorized pre-use (e.g., pre-flight) tampering has occurred. Similarly, it is envisioned that a coded security indicator mechanism could be used to authenticate the beverage dispensing apparatus 2 (i.e., identify that it is not a fake).

In order to operate the present invention, in one embodiment, the user disengages the safety indicator mechanism 110 (if appropriate), unlocks the access panel 40, and slides the access panel 40 down into the housing 8 to reveal the dispensing mechanism 12 (e.g., one or more taps, guns, valves, etc.). The dispensing mechanism 12 slides from the housing 8 so that it can be accessed. In one embodiment, the activation switch 48 is then depressed, thereby activating the pneumatic pump sub-system 44, which results in the pressurization of the interconnected air lines fluid lines 16, and accompanying beverage containers 10. Upon reaching the requisite pressure (i.e., preferably 12 PSIG, but can vary between 1 to 100 PSIG, depending on the type of pump 36, air lines 18, fluid lines 16, and/or beverage containers 10 used), the pump 36 will shut off. The user is free to dispense the desired beverages from the dispensing mechanism 12 (e.g., taps) once adequate positive pressurization is established. As fluid is depleted from each of the beverage containers 10, in one embodiment, the pneumatic pump sub-system 44 will activate as needed to maintain the requisite pressure within the beverage containers 10. In order not to exceed the requisite pressure, however, in one embodiment, the pneumatic pump sub-system 44 is further comprised of a pressure relief valve 111 positioned between the pump 36 and the outlet port 50 and communicates via a manifold 113. See, e.g., FIG. 3. In addition, to avoid back flow of fluid into the pump 36, in one embodiment, a check valve 114 may be interconnected to the air line 18 running to the outlet port 50. See, e.g., FIG. 3.

If during the beverage service, a particular beverage container 10 is emptied, in one embodiment, the user depressurizes the fluid line 16 and beverage container 10 by depressing the air bleed valve 107 of the container connection member 15, and then replaces the beverage container 10 with its newly opened counterpart. Thus, each beverage container 10 can be safely isolated from the system without harm to the user or causing any effect to the remaining beverage containers 10, thereby facilitating individual beverage container removal. In one embodiment, the check valve 114 is interconnected to or integrated into the fluid outlet port 84 of the container connection member 15 or associated fluid line 16 so that any beverage remaining in the fluid line 16 associated with the empty beverage container 10 does not flow back out of the fluid line 16. Of course, a check valve 114 could be interconnected to or integrated into the air inlet port 82 of the container connection member 15 or corresponding air line 18 as well.

In order to facilitate the changing and/or installing of the air lines 18 and/or fluid lines 16, in one embodiment, quick connection members 112 are interconnected between the respective air line 18 or fluid line 16 and its respective component (e.g., container connection member 15). Moreover, the use of quick connection members 112 at one or places throughout the beverage dispensing apparatus 2 would also facilitate the transfer of more than one beverage container 10 at a time. For example, a divider member 108, such as embodied in FIG. 2, could be pre-packed with beverage containers 10, each with an associated container connection member 15 having air lines 18 and fluid lines 16 already attached. In this configuration, the existing divider member 108 could be swapped out with a replacement, pre-packed divider 108 full of new beverage containers 10 and the user would merely need to disconnect and reconnect five connection points (e.g., four connections to each respective dispensing mechanism 15 and one connection to the outlet port 50 of the control panel 14).

If it is desirable to bleed the air pressure from the entire system, in one embodiment, the control module is further comprised of a control mechanism (e.g., a button connected to a valve) mounted on the front panel 38 and in communication with the pneumatic pump sub-system 44. Alternatively, in one embodiment, a biased switch is positioned within the housing 8 so that when the top panel 22 is lifted, the biased switch is triggered and the entire pneumatic pump sub-system 44 is depressurized along with the respective air lines 18 and fluid lines 16.

Once beverage service is complete, in one embodiment, the user merely slides the dispensing mechanism 12 (e.g., taps, guns, faucets, valves, etc.) back into the housing 8, raises the access panel 40, and secures the access panel 40 to the front panel 38 in an upright, closed position. In one embodiment, the activation switch 48 is also turned to an off position, thereby deactivating the pump 36, and the apparatus 2 is returned for storage in the galley. As a result, there are no cans to collect and store as trash, just the cups, which would be collected anyway in conjunction with conventional beverage service. Less waste means less weight and greater storage space for the airlines, both of which are valued commodities. Finally, since there is less actual beverage waste, consumers may be given more beverage than the traditional eight ounce cup, thereby generally increasing passenger satisfaction. Also, the amount of beverage dispensed can be varied to meet the individual needs of the passenger. For example, a child could receive a 5 ounce portion while an adult could obtain a 10 ounce amount. As a result, there may not be a need for the flight attendants to make an additional trip down the aisle with the beverage cart to refill glasses. This would free the flight attendants to perform other tasks and should also increase passenger satisfaction by minimizing unnecessary blockage of the aisle.

In sum, the present invention offers a portable, self-contained system that is a cost-effective alternative to traditional canned beverage service. As noted above, while the present invention fills many needs within the airline industry, there are many other contexts in which it may also be used. Nonetheless, use of the present invention within the airline industry will result in more efficient beverage service (e.g., decreasing service time by approximately 50% or more), which should ultimately be translated into higher customer satisfaction. Elimination of cans will also cause a reduction in weight which will save money on additional fuel. The ability to use translucent beverage containers, and lock and/or seal the present invention prior to use provides an added measure of security. Lastly, the present invention provides the airlines with an alternative that can be immediately used with their existing equipment without modification, thereby generating instant cost savings.

While an effort has been made to describe some alternatives to the preferred embodiment, other alternatives will readily come to mind to those skilled in the art. Therefore, it should be understood that the present invention may be embodied in other specific forms without departing from the spirit or central characteristics thereof. The present examples, figures and embodiments, therefore, are to be considered in all respects as illustrative and not restrictive, and the present invention is not intended to be limited to the details given herein.

What is claimed is:

1. A self-contained beverage dispensing apparatus, comprising:

(a) a housing having a moveable lid, the lid moveable between an open position wherein an interior of the housing is accessible, and a closed position wherein the lid may be secured to another portion of the housing;

(b) at least one beverage container disposed in said housing, a removable cap sealably secured to each of said at least one beverage containers;

(c) at least one dispensing element mounted to said housing and moveable between a first position inside said housing and a second position at least partially outside said housing, said at least one dispensing element in fluid communication with said at least one beverage container;

(d) a control module secured to said housing and comprising a pump in pressurized communication with said at least one beverage container, a power source in electrical communication with said pump, and a switch in electrical communication with said power source, wherein the pump pressurizes said at least one beverage container and causes beverage within said beverage container to move to said at least one dispensing element.

2. The self-contained beverage dispensing apparatus of claim 1, wherein said control module is removable from said housing.

3. The self-contained beverage dispensing apparatus of claim 1, further comprising an air passage way interconnecting the pump and the at least one beverage container, and a sensing member associated with said air passage way to monitor pressure in the air passage way and to turn off the pump when the pressure exceeds a predetermined value.

4. The self-contained beverage dispensing apparatus of claim 3, further comprising said sensing member turning on the pump when the pressure in the passage way is less than a predetermined value.

5. The self-contained beverage dispensing apparatus of claim 1, wherein the power source comprises a rechargeable battery.

6. The self-contained beverage dispensing apparatus of claim 1, wherein said housing further comprises a panel moveable between a first position blocking access to the at least one dispensing element when it is in its first position within said housing and a second position permitting said at least one dispensing element to move to its second position.

7. The self-contained beverage dispensing apparatus of claim 1 further comprising a locking assembly that secures the lid in its closed position and secures the panel in its first position to preclude access to the interior of the housing.

8. The self-contained beverage dispensing apparatus of claim 3 further comprising a fluid passageway interconnecting said at least one beverage container and said at least one dispensing element.

9. The self-contained beverage dispensing apparatus of claim 8, wherein said air and fluid passageways further comprise quick connect/disconnect elements for connecting and disconnecting said air and fluid passageways to said at least one beverage container.

10. The self-contained beverage dispensing apparatus of claim 1, wherein said pump provides a pressure of at least 12 psi.

11. The self-contained beverage dispensing apparatus of claim 1, wherein each said cap further comprises a locking element adapted to secure said cap to said at least one beverage container.

12. The self-contained beverage dispensing apparatus of claim 1, further comprising a security member interconnected to said housing and adapted to indicate if unauthorized tampering with said housing has occurred.

13. The self-contained beverage dispensing apparatus of claim 6, further comprising a security member interconnected to said panel, wherein said security member indicates whether or not said panel has been moved from its first position.

14. The self-contained beverage dispensing apparatus of claim 1, further comprising a security device attached to said lid and indicative of whether the lid has been opened.

15. The self-contained beverage dispensing apparatus of claim 1, wherein said at least one dispensing element is a tap.

16. The self-contained beverage dispensing apparatus of claim 1, wherein said removable cap is further comprised of an air bleed valve.

17. The self-contained beverage dispensing apparatus of claim 11, wherein said at least one dispensing element is a beverage gun.

18. The self-contained beverage dispensing apparatus of claim 12, wherein said security member is a wire and lead seal assembly.

19. The self-contained beverage dispensing apparatus of claim 12, wherein said security member interconnects said lid and another portion of said housing.

20. A portable beverage dispensing apparatus for use in connection with mobile beverage service on commercial airlines comprising:

(a) a housing designed to rest upon a top surface of a rolling cart;

(b) a plurality of beverage containers disposed in the housing;

(c) at least one beverage dispensing element in fluid communication with the plurality of beverage containers;

(d) a control module associated with the housing and adapted to regulate fluid pressure among the plurality of beverage containers and the at least one beverage dispensing element;

wherein the control module, the at least one beverage dispensing element, and the plurality of beverage containers can be selectively locked within the housing.

21. The portable beverage dispensing apparatus of claim 20, wherein the plurality of beverage containers comprises four beverage containers.

22. The portable beverage dispensing apparatus of claim 20, wherein the at least one beverage dispensing element comprises four beverage nozzles, one associated with each beverage container.

23. The portable beverage dispensing apparatus of claim 20, wherein said control module comprises a pump, a rechargeable power source, an electric motor and a pressure sensor associated with said pump, wherein said electric motor is operable to turn on the pump if the pressure is less than a predetermined value and to turn off the pump if the pressure is above a predetermined value.

24. The portable beverage dispensing apparatus of claim 20, wherein the control module is removable from said housing.

25. The portable beverage dispensing apparatus of claim 20, wherein the beverage containers are commercially available two liter plastic bottles.

26. The portable beverage dispensing apparatus of claim 20, wherein the housing has a width of no greater than 14 inches and a length of no greater than 34 inches so that the housing fits on the top surface of the rolling cart.

27. The portable beverage dispensing apparatus of claim 20, wherein the housing has a length of no greater than 18 inches, a width of no greater than 14 inches, and a height of no greater than 15 inches so that the housing fits within a cargo storage compartment of an aircraft.

28. The portable beverage dispensing apparatus of claim 20, wherein the at least one beverage dispensing element is a beverage gun.

29. The portable beverage dispensing apparatus of claim 20, wherein the plurality of beverage containers are serially connected in fluid communication.

30. The portable beverage dispensing apparatus of claim 20, wherein the housing is selectively secured by a security indicator mechanism for identifying unauthorized access to an interior of the housing or indicating that the housing is a fake.

31. The portable beverage dispensing apparatus of claim 30, wherein the security indicator mechanism is a paper seal.

32. The portable beverage dispensing apparatus of claim 30, wherein the security indicator mechanism is a wire and seal assembly.

33. A beverage dispensing device, comprising:

(a) a housing having an inner surface and an outer surface;

(b) a security member interconnected to the outer surface of the housing, wherein the security member is adapted to indicate any tampering with the housing prior to use;

(c) at least one dispensing mechanism encased by and in slidable communication with the housing;

(d) a pressurized line system in fluid communication with the at least one dispensing mechanism; and (e) at least one container connection member in fluid communication with the at least one dispensing mechanism and the pressurized line system; and wherein the at least one container connection member is further comprised of an air bleed valve.

34. A beverage dispensing device, comprising:

(a) a housing having an inner surface and an outer surface;

(b) a security member interconnected to the outer surface of the housing, wherein the security member is adapted to indicate any tampering with the housing prior to use;

(c) at least one dispensing mechanism encased by and in slidable communication with the housing;

(d) a pressurized line system in fluid communication with the at least one dispensing mechanism;

(e) at least one container connection member in fluid communication with the at least one dispensing mechanism and the pressurized line system; and wherein the at least one container connection member is further comprised of a pliable outer member to accept varying sized throats of beverage containers.

35. A self-contained beverage dispensing device, comprising:

(a) a housing having an interior cavity of sufficient dimension to encase at least four 2 liter bottles;

(b) four dispensing mechanisms, each movable from a stored position to an accessible position;

(c) a control module powered by a rechargeable battery and activated by an interconnected switch;

(d) a lid interconnected to the housing for accessing the at least four 2 liter bottles;

(e) four caps in fluid communication with the four dispensing mechanisms via fluid lines and in pneumatic communication with the control module via air lines; and wherein the control module pressurizes the air lines and fluid lines to a pre-determined pressure and then is shut off by a valve;

further wherein the four caps are each further comprised of an air bleed valve to selectively relieve the pressure in each respective 2 liter bottle.

* * * * *